US012428952B2

(12) United States Patent
Kalwar et al.

(10) Patent No.: US 12,428,952 B2
(45) Date of Patent: Sep. 30, 2025

(54) HYDROSTATIC BAILER AND LEAD IMPRESSION BLOCK COMBINATION TOOL FOR DOWNHOLE FISH DIAGNOSIS AND SOLIDS STRIPPING THROUGH SAMPLE COLLECTION

(71) Applicant: SAUDI ARABIAN OIL COMPANY, Dhahran (SA)

(72) Inventors: Ghulam Murtaza Kalwar, Udhailiyah (SA); Abdullah A Mulhim, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/592,233

(22) Filed: Feb. 29, 2024

(65) Prior Publication Data

US 2025/0277443 A1 Sep. 4, 2025

(51) Int. Cl.

| | |
|---|---|
| ***E21B 47/098*** | (2012.01) |
| ***E21B 27/00*** | (2006.01) |
| ***E21B 47/09*** | (2012.01) |

(52) U.S. Cl.

CPC ..... *E21B 47/098* (2020.05); *E21B 27/00* (2013.01); *E21B 47/09* (2013.01); *E21B 2200/04* (2020.05); *E21B 2200/05* (2020.05)

(58) Field of Classification Search

CPC .. E21B 2200/04; E21B 2200/05; E21B 27/00; E21B 47/09

See application file for complete search history.

(56) References Cited

U.S. PATENT DOCUMENTS

| | | | |
|---|---|---|---|
| 702,653 | A | 6/1902 | Jackson |
| 1,832,323 | A | 11/1931 | Rigby |

(Continued)

FOREIGN PATENT DOCUMENTS

| | | | |
|---|---|---|---|
| CN | 109505550 | A | 3/2019 |
| CN | 118128523 | A | 6/2024 |
| EP | 2 780 536 | A1 | 9/2014 |

OTHER PUBLICATIONS

Hydrostatic Bailer [Product Catalog]. BDK Intervention Products; 2019. Accessed Jan. 6, 2025; https://www.weatherford.com/documents/catalog/bdk-intervention-products-catalog/ (Year: 2019).*

(Continued)

*Primary Examiner* — Tara Schimpf
*Assistant Examiner* — Daniel T Craig
(74) *Attorney, Agent, or Firm* — Osha Bergman Watanabe & Burton LLP

(57) ABSTRACT

An apparatus includes a hydrostatic bailer and a lead impression block. The hydrostatic bailer is disposed in the well and removes debris from the fish using a plunger, a shear pin, and a valve. The valve controls hydraulic communication between an orifice of a hollow body of the valve and a cavity of the hydrostatic bailer by opening and closing. The shear pin is configured to shear and allow the plunger to move within the hydrostatic bailer to open the valve and remove the debris from the fish. The lead impression block is connected to the hollow body of the valve in the hydrostatic bailer. The lead impression block is configured to set against the fish, using the hydrostatic bailer, and obtain an impression of the fish on a single run into the well in which the debris is removed from the fish.

9 Claims, 3 Drawing Sheets

(56) References Cited

U.S. PATENT DOCUMENTS

| | | | | |
|---|---|---|---|---|
| 1,843,217 | A | 2/1932 | Fletcher | |
| 2,166,489 | A | 7/1939 | Gates | |
| 2,191,223 | A | 2/1940 | Van Stone et al. | |
| 2,399,844 | A | 5/1946 | Alkire | |
| 2,454,945 | A | 11/1948 | Reynolds | |
| 2,689,534 | A | 9/1954 | Mack | |
| 2,824,378 | A | 2/1958 | Stokes | |
| 2,992,682 | A | 7/1961 | Yates | |
| 5,163,515 | A * | 11/1992 | Tailby | E21B 23/08 166/383 |
| 5,944,100 | A | 8/1999 | Hipp | |
| 6,041,860 | A | 3/2000 | Nazzal et al. | |
| 8,307,895 | B2 | 11/2012 | Lund | |
| 11,965,414 | B2 | 4/2024 | Nafa et al. | |
| 12,024,994 | B1 | 7/2024 | Alsulaim et al. | |
| 2002/0174987 | A1 | 11/2002 | Hoffman et al. | |
| 2010/0212890 | A1 | 8/2010 | Lund | |
| 2016/0102527 | A1 | 4/2016 | Manson et al. | |
| 2016/0341002 | A1 * | 11/2016 | McKitrick, III | E21B 34/142 |
| 2023/0082225 | A1 | 3/2023 | Nafa et al. | |

OTHER PUBLICATIONS

Lead Impression Block [Product Catalog]. Innovex; 2022. Accessed Jan. 6, 2025; https://www.innovex-inc.com/wp-content/uploads/Lead-Impression-Blocks.pdf (Year: 2022).*

Brio-Tech Pressure Controls Inc., "Hydrostatic Bailer"; <https://brio-techpce.com/wp-content/uploads/2023/08/Hydrostatic-Bailer-Brio-Tech-Catalog-revised-1.01-s-3-NEW.pdf>; Accessed Feb. 28, 2024 (1 page).

LiMAR Well Intervention Products UK, "Hydrostatic Bailer—Flapper Type"; <https://www.limaroiltools.com/assets/pdfs/wireline/2021/05/17/78a866b6-e53f-4b96-849c-d02372ea21f2.pdf?v=1&name=1086%20-%20Hydrostatic%20Bailer%20%E2%80%93%20Flapper%20Type.pdf>; Accessed Feb. 28, 2024 (2 pages).

LiMAR Well Intervention Products UK, "Hydrostatic Bailer—Ball Type"; <https://www.limaroiltools.com/assets/pdfs/wireline/2021/05/17/788b4252-e8c6-4062-bb49-59394a9109bf.pdf?v=1&name=1015%20-%20Hydrostatic%20Bailer%20%E2%80%93%20Ball%20Type.pdf>; Accessed Feb. 28, 2024 (2 pages).

Western Pressure Controls Ltd, "Hydrostatic Bailer"; <https://westernpressure.com/product_images/import/schematics/K1.250HB00.pdf>; Accessed Feb. 28, 2024 (2 pages).

Peak Well Systems, "Hydrostatic Bailer"; Oct. 9, 2020; <https://www.peakwellsystems.com/media/228513/114_hydrostatic_bailer_pws_dsheet.pdf>; Accessed Feb. 28, 2024 (1 page).

Dedicated to Intervention, "Hydrostatic Bailer"; <https://dti.uk.com/Slickline/Bailers/hydrostatic-type-bailer>; Accessed Feb. 28, 2024 (2 pages).

Hunting PLC, "Hydrostatic Bailers"; <https://cdn.sanity.io/files/bwa44qrg/ production/38c9fcbf6cfd63dcfdeab741c404cef81b0136fe.pdf>; Accessed Feb. 28, 2024 (1 page).

Brace Tool Inc., "Hydrostatic Bailer"; <https://assets-global.website-files.com/65144f2ab86f0c7800beb8f9/6524756d0d07465bb4ebaca0_913d9f2992e3463c90494357e98588fd.pdf>; Accessed Feb. 28, 2024 (2 pages).

Elmartm, "ElmarTM Tools Wireline & Flow Control Products"; <https://edge.sitecorecloud.io/nationaloil37c5-novinc-prod-e309/media/nov/files/products/caps/intervention-and-stimulation-equipment/slickline-tools-and-flow-control/elmar-wireline-tools-catalog.pdf>; pp. 35; Accessed Feb. 28, 2024 (1 page).

Weatherford International, "BDK Intervention Products"; <https://www.weatherford.com/documents/catalog/bdk-intervention-products-catalog/>; pp. 18; Accessed Feb. 28, 2024 (1 page).

Non-Final Office Action issued by the U.S. Patent Office for corresponding U.S. Appl. No. 18/592,133, mailed Dec. 23, 2024 (11 pages).

* cited by examiner

HYDROSTATIC BAILER AND LEAD IMPRESSION BLOCK COMBINATION TOOL FOR DOWNHOLE FISH DIAGNOSIS AND SOLIDS STRIPPING THROUGH SAMPLE COLLECTION

BACKGROUND

In the oil and gas industry, hydrocarbons are located in porous rock formations beneath the Earth's surface. Hydrocarbons are accessed by drilling wells into the formation(s). A well is a series of concentric holes drilled into the surface of the Earth where each hole is supported by a casing string cemented in place. In order to produce the hydrocarbons, a production string is often run and set within the inner-most casing string. A production string is a series of tubulars connected to one another. The production string is used to provide a conduit for hydrocarbon migration to the surface. Often, other production equipment, such as pumps and separators, are included in the production string to aid production of the hydrocarbons.

During the life of a well, the well may require one or more fishing operations. Fishing operations occur when equipment is purposefully or accidentally left in the well and the equipment needs to be retrieved. Fishing operations may occur after the well has been on production to retrieve production equipment to either maintain the well, secondarily complete the well, or replace the equipment. These fishing operations may be run directly in the interior casing string, with the production tubing removed from the well, or the fishing operations may require through-tubing access to the well. Through-tubing access is a method that includes running tools through the inside of the production tubing to perform operations downhole.

Prior to running fishing tools into the well, a drifting operation may be performed to ensure that the fishing tools may fit in the tubular though which they will be deployed, whether that be the casing string or production tubing. Drifting conventionally consists of running a tool, having a diameter assumed to be the accessible inner diameter of the inner-most tubular, through the inside of the tubular to determine the wellbore accessibility.

Once the depth of the fish and the accessibility of the well is confirmed via the drifting operation, a lead impression block may be run to determine the position of the fish, i.e., whether it is centered or off to one side, and identify the structural make-up of the upper surface/fishneck of the fish. A bailer may also be run into the well, on a separate trip, to collect and clear debris that has settled on the fish. This allows the fishneck to be clear of debris, allowing a higher success rate of fishing the object from the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and apparatuses for detecting a fish in a well. The apparatus includes a hydrostatic bailer and a lead impression block. The hydrostatic bailer is configured to be disposed in the well and remove debris from an upper surface of the fish. The hydrostatic bailer comprises a plunger located within a cavity of the hydrostatic bailer, a shear pin holding the plunger in a loaded position within the hydrostatic bailer, and a valve connected to a downhole end of a lower chamber sub and configured to control hydraulic communication between an orifice of a hollow body of the valve and the cavity of the hydrostatic bailer by opening and closing. The shear pin are configured to shear and allow the plunger to move within the hydrostatic bailer and movement of the plunger causes the valve to open and remove the debris from the upper surface of the fish. The lead impression block is connected to the hollow body of the valve in the hydrostatic bailer. The lead impression block is configured to set against the fish, using the hydrostatic bailer, and obtain an impression of the fish.

The method includes running an apparatus, having a lead impression block connected to a hydrostatic bailer using a valve, to a location adjacent to the fish in the well, lowering the apparatus onto the fish to obtain an impression of the fish on the lead impression block, and shearing a shear pin in the hydrostatic bailer to allow a plunger to move and cause a pressure equalization to occur between a cavity of the hydrostatic bailer and a conduit of the well to open the valve. The method further includes removing debris from an upper surface of the fish, through the valve, and into the cavity of the hydrostatic bailer using the pressure equalization, holding the debris in the cavity of the hydrostatic bailer using the valve, and pulling the apparatus from the well to analyze the debris and the impression of the fish to determine what type of fishing tool and fishing operation should be performed on the well to remove the fish from the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
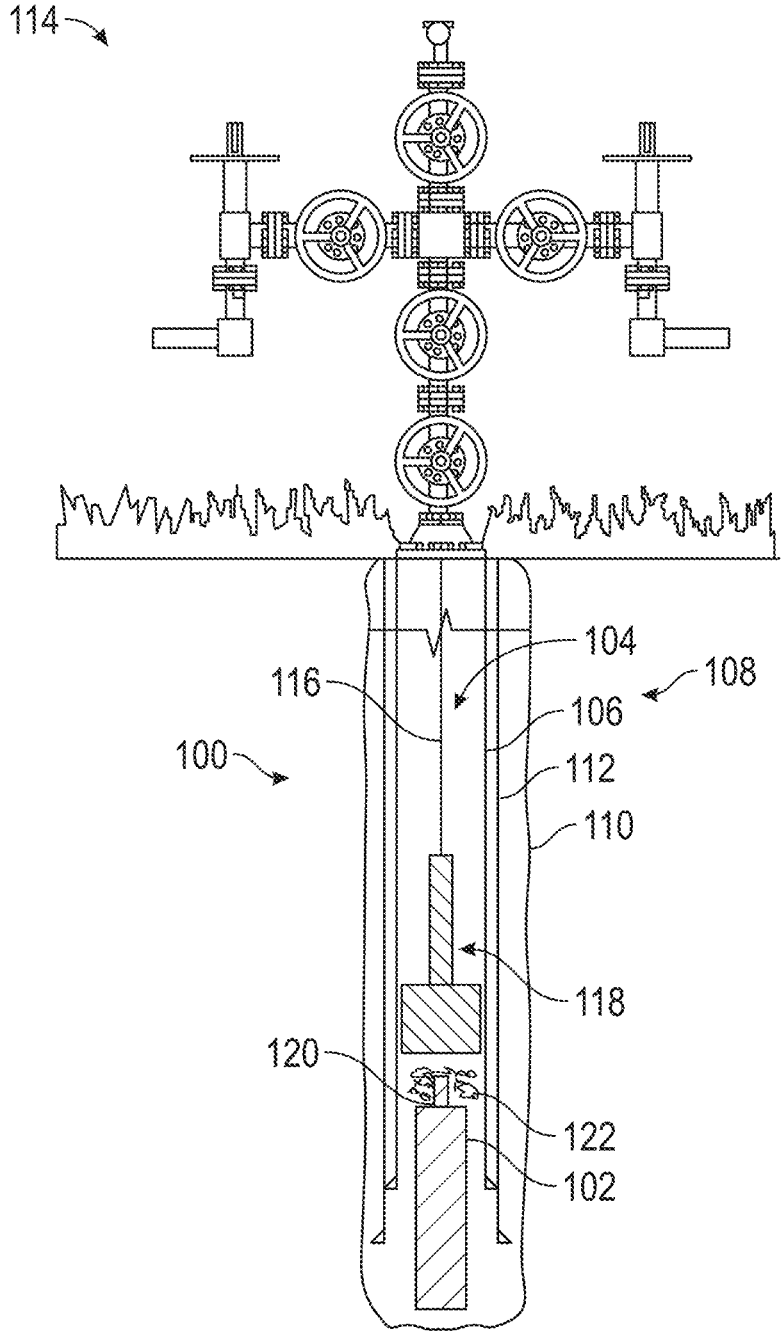
FIG. 1 shows a schematic cross-sectional view illustrating a system for detecting a fish, having an upper surface, in a conduit of a tubular located in a well in accordance with one or more embodiments.

FIG. 1 shows a schematic cross-sectional view illustrating a system (100) for detecting a fish (102), having an upper surface (120), in a conduit (104) of a tubular (106) located in a well (108) in accordance with one or more embodiments. The well (108) shown in FIG. 1 is shown for exemplary purposes and is not meant to be limiting. A person skilled in the art will appreciate that a well having any type of surface equipment, well schematic, design, or trajectory may be used herein without departing from the scope of the disclosure.

In accordance with one or more embodiments, the well (108) includes a wellbore (110) drilled into the surface of the Earth. A casing string (112) is cemented in place in the wellbore (110). A tubular (106) is disposed within the casing string (112). The tubular (106) may be a production string or an inner casing string deployed inside an outer casing string (112) without departing from the scope of the disclosure herein.

The well (108) further includes a production tree (114) housing the surface-extending portion of the casing string (112) and the surface-extending portion of the tubular (106). The production tree (114) is a series of spools and valves that are used to enable production of fluids from the well (108) and enable downhole access to the well (108). Herein, the term "production tree (114)" may encompass the wellhead, casing head(s), and the tubing head without departing from the scope of the disclosure herein. There may be other configurations of equipment on the surface, depending on the operation being performed on the well (108), without departing from the scope of the disclosure herein. For example, there may be a drilling rig located on the surface and there may be no production tree (114) installed on the well (108).

The system (100) includes a deployment device (116) connected to an apparatus (118). The deployment device (116) is used to raise and lower the apparatus (118) inside of the tubular (106). The deployment device (116) may be any type of deployment device known in the art, such as coiled tubing, slickline, or wireline. An input may direct the deployment device (116) to extend the apparatus (118) further into the tubular (106) or retract the apparatus (118) further out of the tubular (106). Surface equipment associated with the deployment device (116) is not shown, but a person skilled in the art will appreciate that the equipment needed to operate the deployment device (116) would be present at the well site.

The fish (102) may be any type of equipment known in the art that may be left in the well (108), accidentally or purposefully, without departing from the scope of the disclosure herein. For example, the fish (102) may be a broken off component of a drill string, a stuck workover tool, a plug, portions of a production string, etc. In accordance with one or more embodiments, the fish (102) has an upper surface (120). The upper surface (120) may be the up-hole extending portion of the fish (102), such as a fishneck.

In accordance with further embodiments, debris (122) may be located on the upper surface (120) of the fish (102). The debris (122) may be loose material in a well (108), such as sand, metallic pieces, wire pieces, soft scale, etc. The fish (102) may be removed from the well (108) using a fishing operation. A fishing operation includes running a fishing tool into the well (108) that is configured to attach to the upper surface (120) to remove the fish (102) from the well (108)

Prior to performing the fishing operation on the well (108), a drifting operation may be performed. In accordance with one or more embodiments, drifting includes running a gauge cutter drift tool, having a diameter assumed to be the accessible inner diameter of the inner-most tubular (106), through the inside of the tubular (106) to determine the accessibility of the well (108). In other embodiments, the gauge cutter drift tool may have an outer diameter larger than an outer diameter of the bottom hole assembly of the fishing tool that is planned to be run into the well (108) for the fishing operation.

Once the drifting operation has confirmed/determined the depth of the fish (102) and the accessibility of the well (108), the apparatus (118) may be used to both clear the debris (122) on the upper surface (120) of the fish (102) and obtain an impression of the fish (102) in the same run. The impression is a mirror image of the upper surface (120) of the fish (102). The impression may be analyzed at the surface to determine the design and type of fishing tool. The debris (122) is cleared from the upper surface (120) of the fish (102) to enable the fishing tool to successfully latch onto the upper surface (120) of the fish (102) and pull the fish (102) from the well (108). The apparatus (118) is shown having two different configurations outlined below in FIG. 2 and FIG. 3.

Figure 2:
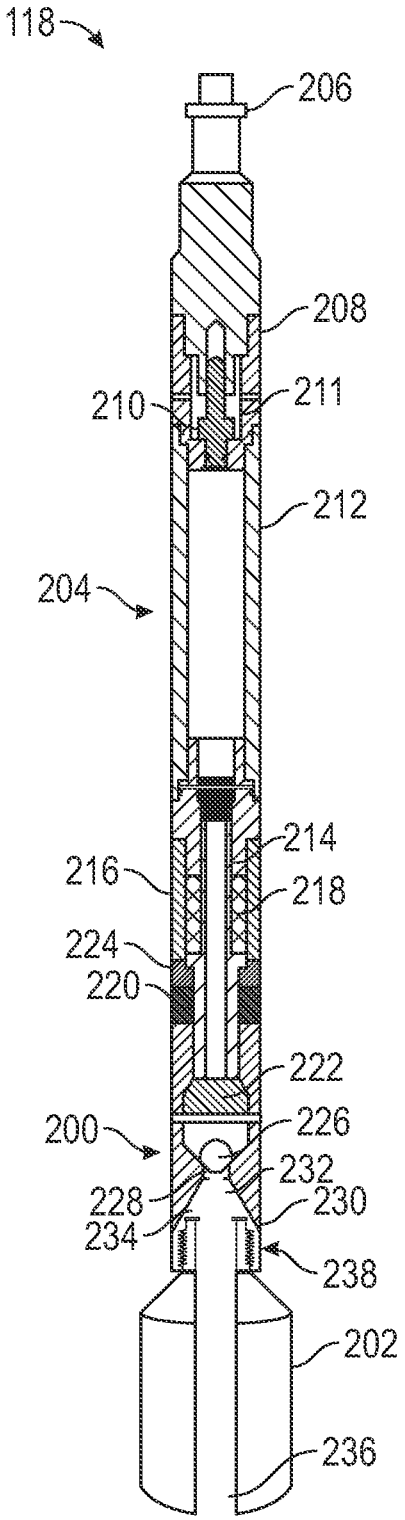
FIG. 2 shows the apparatus having a ball valve in accordance with one or more embodiments.

FIG. 2 shows the apparatus (118) having a ball valve (200) in accordance with one or more embodiments. Specifically, the apparatus (118) includes a lead impression block (LIB) connected to a hydrostatic bailer (204) that is operable using, in part, the ball valve (200). In accordance with one or more embodiments, the hydrostatic bailer (204) uses a sealed cavity (222) at atmospheric pressure to remove debris (122) from the tubular (106). The cavity (222) may be sealed by a pin (224) without departing from the scope of the disclosure herein.

In accordance with one or more embodiments, the hydrostatic bailer (204) includes a fishneck (206), an upper chamber sub (208), an equalizing dart (210), a middle chamber sub (212), a plunger housing (214), a lower chamber sub (216), a plunger plug (218), and a plunger (220). The fishneck (206) is used to connect the apparatus (118) to the deployment device (116). The fishneck (206) may also be used to interact with a fishing tool in order to remove the apparatus (118) from the well (108), if the apparatus (118) parts from the deployment device (116) or becomes stuck in the well (108).

The fishneck (206) is located on the up-hole-most end of the apparatus (118). The fishneck is connected to the upper chamber sub (208). The equalizing dart (210) is located in a dart housing (211) connected to the upper chamber sub (208). The middle chamber sub (212) is connected to the dart housing (211). The plunger housing (214) is connected to the middle chamber sub (212) and houses the plunger (220). The lower chamber sub (216) is connected to the plunger housing (214) and houses the plunger plug (218). These aforementioned connections may be any type of connections known in the art, such as threaded, bolted, or welded connections. In further embodiments, one or all of the portions of the hydrostatic bailer (204) are manufactured together as one component.

Herein, the terms up/upwards/above/top is relative to a direction going from the ball valve (200) towards the fishneck (206), and down/below/under/beneath is relative to a direction going from the fishneck (206) towards the ball valve (200).

A cavity (222) is also located in the lower chamber sub (216). The cavity (222) is loaded at atmospheric pressure at the surface and sealed off. The cavity (222) is loaded at atmospheric pressure by placing the plunger (220) in a loaded position, using shear pins (224). Herein, the term shear pin (224) may be synonymous with a rupture or break disk without departing from the scope of the disclosure herein. The shear pins (224) prevent the plunger (220) from moving within the plunger housing (214) until the shear pins (224) are sheared/broken. When the apparatus (118) reaches the upper surface (120) of the fish (102), downward jarring of the apparatus (118) shears the pins (224) holding the plunger (220) in the loaded position.

With the pins (224) sheared, the plunger (220) is able to freely move within the plunger housing (214). This ability to move causes an influx of wellbore fluid and debris (122) to enter the cavity (222), due to the pressure differential. Once the pressure within the cavity (222) is equalized to the pressure in the tubular (106), the wellbore fluid and debris (122) are held within the cavity (222).

The plunger plug (218) is connected to (or is a part of) the plunger (220) and is sized such that it seals against the interior wall of the plunger housing (214). This sealing aspect prevents pressure equalization across the plunger plug (218). Thus, the cavity (22) is able to remain at atmospheric pressure until the plunger (220) and plunger plug (218) are able to freely move in an upwards direction. The equalizing dart (210) acts as a pressure relief valve, which allows the plunger plug (218) and plunger (220) to move in the upward direction when the cavity (222) equalizes to wellbore pressure.

In accordance with one or more embodiments, the wellbore fluid and debris (122) are held within the cavity (222) of the hydrostatic bailer (204), unable to escape, using the ball valve (200). The ball valve (200) includes a ball (226), a ball seat (228), and a hollow body (230). When the pins (224) are sheared and the plunger (220) is able to move freely within the plunger housing (214), the ball (226) moves in an upward direction and off of the ball seat (228).

The ball seat (228) has an inlet (232) that hydraulically connects an orifice (234) of the hollow body (230) below the ball seat (228) to the cavity (222) in the hydrostatic bailer (204) above the ball seat (228). Thus, when the ball (226) is moved off of the ball seat (228), the inlet (232) is uncovered, and the wellbore fluid and debris (122) may travel through the inlet (232) into the cavity (222) of the hydrostatic bailer (204) from the orifice (234) below.

Once the pressure equalizes within the cavity (222), the ball (226) falls back onto the ball seat (228) to cover the inlet (232). Thus, the wellbore fluids and debris (122) are trapped within the cavity (222). At this point, the apparatus (118) may be pulled to the surface and the debris (122) may be removed from the hydrostatic bailer (204) and analyzed.

In accordance with one or more embodiments, a LIB (202) is connected to the hollow body (230) of the ball valve (200). In accordance with one or more embodiments, to create the LIB (202), the shoe of the ball valve (i.e., the downhole-most end of the hollow body (230)) may be filled with lead and a pathway (236) may be formed into the center of the LIB (202).

In other embodiments, the LIB (202) may be a separate sub manufactured having a lead block at the bottom of the sub. A pathway (236) may also be manufactured through the center of the sub such that the orifice (234) of the hollow body (230) is in fluidic connection with an external environment of the apparatus (118) (e.g., the interior of the tubular (106) when the apparatus (118) is run into the tubular (106)). The sub may be connected to the downhole-most end of the hollow body (230) of the ball valve (200) using any type of connection known in the art, such as a threaded connection (238), a welded connection, a bolt/flange connection, etc.

The lead in the LIB (202) is soft enough such that when the apparatus (118) is jarred on the fish (102), the lead is able to take an impression of the fish (102). When the apparatus (118) is brought to the surface, the impression in the LIB (202) may be analyzed to determine the position of the upper surface (120) of the fish (102) in the well (108), as well as the physical make-up of the upper surface (120). After the LIB (202) has taken one impression, the lead in the LIB (202) may be redressed so that the apparatus (118) may be run again into the same well (108) or into a different well.

With the apparatus (118) having both a hydrostatic bailer (204) and a LIB (202), the apparatus (118) can clear the debris (122) off of the upper surface (120) of the fish (102) as well as take an impression of the fish (102) on the same run. This saves time and allows the fish (102) to be dealt with more effectively. It is important that the fish (102) be removed efficiently because the less time spent on a well (108) reduces the likelihood of wellbore incidents. The impression of the fish (102) may be used to determine the type of fishing tool to be used as well as how to use the fishing tool to remove the fish (102) from the well (108).

Figure 3:
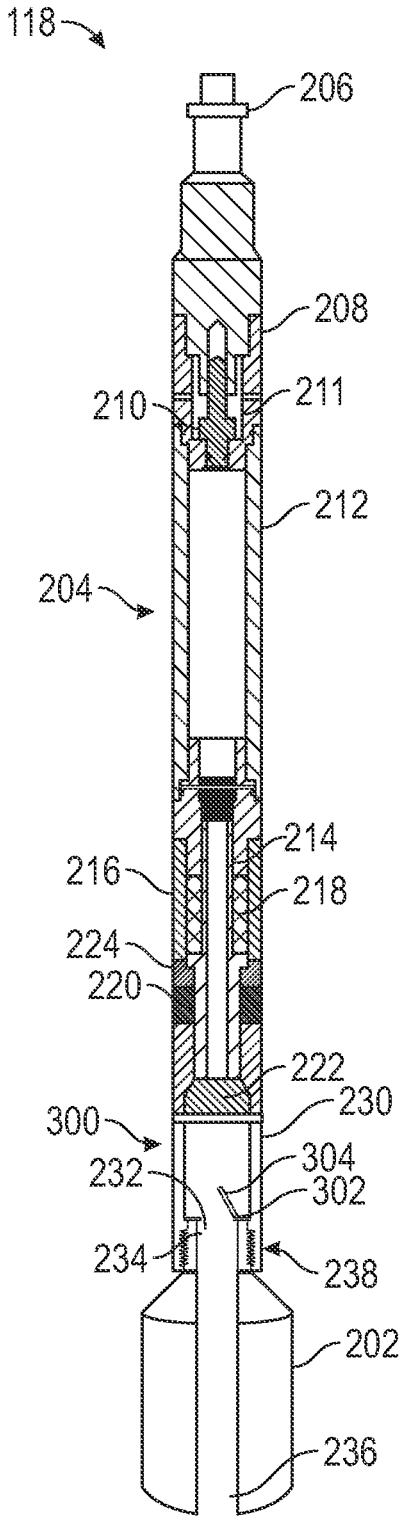
FIG. 3 shows the apparatus having a flapper valve in accordance with one or more embodiments.

FIG. 3 shows the apparatus (118) having a flapper valve (300) in accordance with one or more embodiments. Components shown in FIG. 3 that are the same as or similar to components shown in FIGS. 1 and 2 have not been redescribed for purposes of readability and have the same description and function as outlined above.

In accordance with one or more embodiments, the apparatus (118) shown in FIG. 3 is substantially the same as the apparatus (118) shown in FIG. 2, except for the valve. In FIG. 2, the hydrostatic bailer (204) of the apparatus (118) is operable using the ball valve (200). In FIG. 3, the hydrostatic bailer (204) of the apparatus (118) is operable using a flapper valve (300). Herein, the terms up/upwards/above/top is relative to a direction going from the flapper valve (300) towards the fishneck (206), and down/below/under/beneath is relative to a direction going from the fishneck (206) towards the flapper valve (300).

As such, FIG. 3 shows a LIB (202) connected to a hydrostatic bailer (204) via the flapper valve (300). The LIB (202) is connected to the flapper valve (300) in a similar manner to how the LIB (202) is connected to the ball valve (200), as outlined above. The apparatus (118) having both the LIB (202) and the hydrostatic bailer (204) allows the apparatus (118) to take an impression of the fish (102), using the LIB (202), and remove the debris (122) from the upper surface (120) of the fish (102), using the hydrostatic bailer (204). Specifically, the hydrostatic bailer (204) receives an influx of wellbore fluid and debris (122), as outlined above.

In accordance with one or more embodiments, the wellbore fluid and debris (122) are held within the cavity (222) of the hydrostatic bailer (204), unable to escape, using the flapper valve (300). The flapper valve (300) includes a hollow body (230) having an orifice (234), a flapper seat (302) having an inlet (232), and a flapper (304) configured to cover and uncover the inlet (232).

In accordance with one or more embodiments, the flapper (304) is connected to the flapper seat (302) on one end using a hinge or a spring. This leaves the other end unconnected to the flapper seat (302). As such, the flapper (304) is able to open (i.e., move away from the flapper seat (302)) when a pressure is applied to the flapper (304) in an upwards direction and close (i.e., press against the flapper seat (302)) when a pressure is applied to the flapper (304) in a downwards direction. Thus, when the pin (224) is sheared and the plunger (220) is able to freely move within the plunger housing (214), a pressure is applied in an upwards direction on the flapper (304) and the flapper (304) moves away from the flapper seat (302).

The inlet (232) of the flapper seat (302) hydraulically connects the orifice (234) of the hollow body (230) below the flapper seat (302) to the cavity (222) in the hydrostatic bailer (204) above the flapper seat (302). Thus, when the flapper (304) opens and uncovers the inlet (232), the wellbore fluid and debris (122) may travel through the inlet (232) into the cavity (222) of the hydrostatic bailer (204) from the orifice (234) below.

Once pressure is equalized within the hydrostatic bailer (204), the flapper (304) moves to cover the flapper seat (302) and cover the inlet (232). Thus, the wellbore fluids and debris (122) are trapped within the cavity (222) of the hydrostatic bailer (204). At this point, the apparatus (118) may be pulled to the surface and the debris (122) may be removed from the hydrostatic bailer (204) and analyzed.

Figure 4:
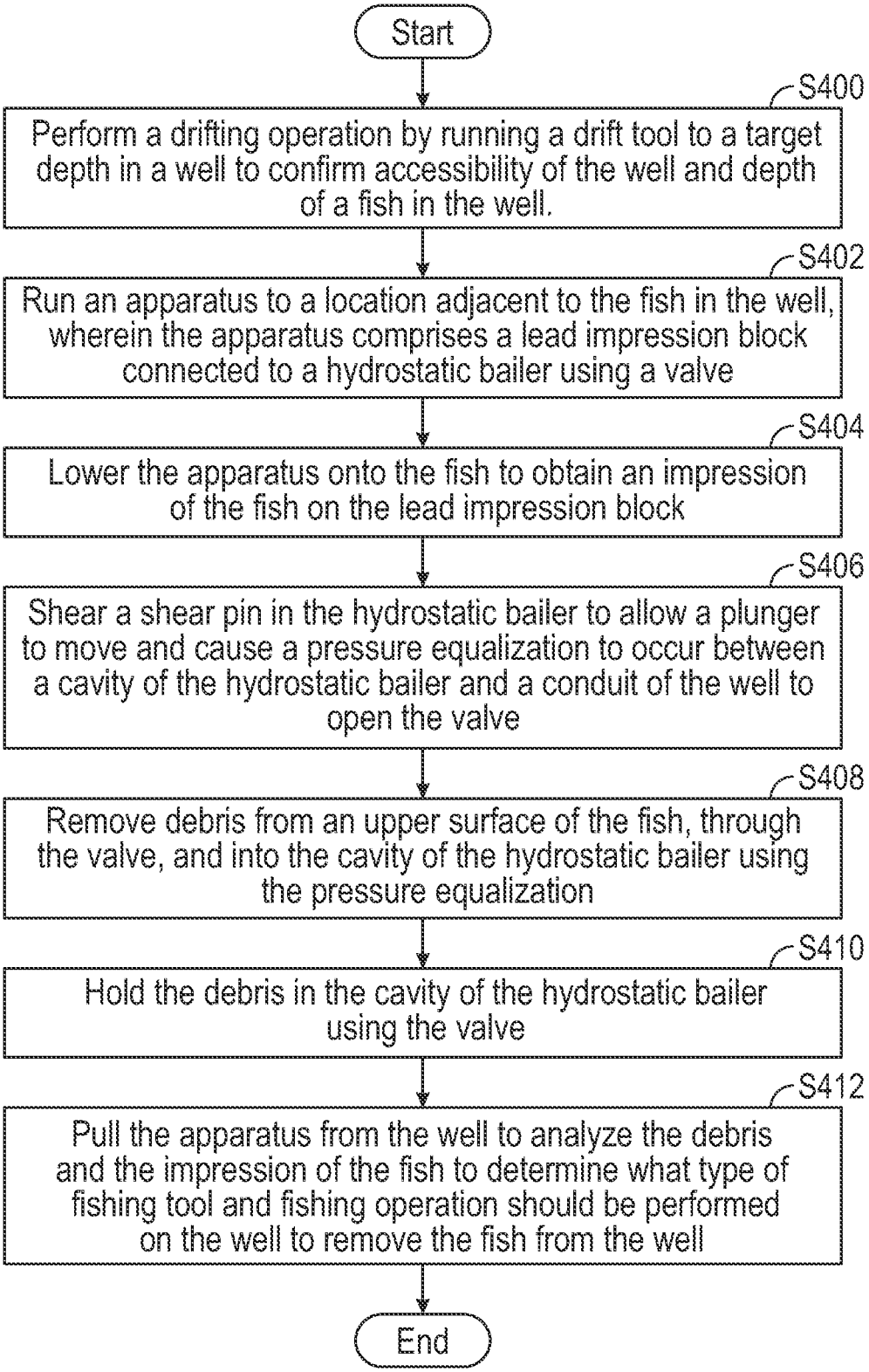
FIG. 4 shows a flowchart in accordance with one or more embodiments. The flowchart outlines a method for detecting a fish in a tubular.

FIG. 4 shows a flowchart in accordance with one or more embodiments. The flowchart outlines a method for detecting a fish (102) in a tubular (106). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S400, a drifting operation is performed by running a drift tool to a target depth in a well (108) to confirm accessibility of the well (108) and depth of a fish (102) in the well (108). In accordance with one or more embodiments, equipment may be purposefully or intentionally left behind in a well (108). For example, downhole tools may become stuck and left behind in a well (108), or temporary tools may be installed in the well, such as plugs or production equipment. For a plethora of reasons, this equipment may need to be removed at some point in the life of the well (108). The equipment is removed using a fishing operation. However, prior to a fishing operation being performed on a well (108), a drifting operation may need to be performed. The drifting operation allows the operator to confirm the depth of the fish (102) and the accessibility of the well (108). An example drifting operational sequence is outlined herein, but a person skilled in the art will appreciate that any drifting operational sequence may be used without departing from the scope of the disclosure herein.

To begin the drifting operation, a slickline unit, a crown/swab valve adapter spool, and pressure control equipment (such as lubricators and blow-out preventors) having the required pressure rating are rigged up on the production tree (114) of the well (108) and are pressure tested according to operational barrier requirements. A bottom hole assembly (BHA) is made up along with a gauge cutter drift tool.

The gauge cutter may be sized to "full-bore size," which may be equivalent to the known minimum inner diameter of the tubular (106). As outlined above, the objective of the gauge cutter is to confirm wellbore accessibility either prior to running any downhole tool, e.g., plugs, perforation guns, gauges, logging tools, etc., or as a part of wellbore accessibility diagnostic operations for a low performance well.

Prior to running the gauge cutter in the well (108), all BHA components are calipered and the dimensions (including outer diameters and lengths) are recorded. To run the gauge cutter in the well (108), the tool string, including the BHA and gauge cutter, are picked up and lowered into the lubricator.

Pressure between the well (108) and the tool string is equalized across the tool string within the lubricator. Specifically, pressure is bled to the shut-in wellhead pressure to equalize across the master valve. Once pressure is equalized, the master valve is opened, and a fusible lockout cap may be installed on the surface safety valve/hydraulic mater valve to avoid accidental closure of the hydraulic valve during slickline operations.

The gauge cutter may then be run into the tubular (106). The gauge cutter may be lowered to a target depth in the well (108). In accordance with one or more embodiments, the target depth is the assumed depth of the fish (102) in the well (108). In further embodiments, the gauge cutter may be run to a depth 100 feet up-hole from the assumed depth of the fish (102).

The tool string may be slowly lowered to the depth upper surface (120) of the fish (102). The tag may be analyzed to be a soft tag or a hard tag. The tool string having the gauge cutter must be removed prior to running the apparatus (118) into the well (108). Specifically, the tool string may be pulled up to a depth 100 feet below the master valve. At this point, the tool string may be slowly raised into the lubricator while the weight indicator is monitored.

Once the tool string is in the lubricator, the swab/crown valve may be closed. Pressure may be equalized between the tool string and the atmosphere, and the tool string may be removed from the lubricator. Once removed, the gauge cutter tool may be disassembled from the BHA of the tool string and the apparatus (118) may be installed in the BHA of the tool string.

The apparatus (118) may be function tested by checking the movement of the plunger (220) and a new shear pin (224) may be installed. All connections may be checked, cleaned, greased, and tightened, and the LIB (202) may be checked for any impression. Pictures of the face and side of the LIB (202) may be taken before and after each run for comparison.

In S402, an apparatus (118) is run to a location adjacent to the fish (102) in the well (108). The apparatus (118) comprises a LIB (202) connected to a hydrostatic bailer (204) using a valve. In accordance with one or more embodiments, the LIB (202) may be connected to the hydrostatic bailer (204) by filling lead into a shoe of the valve to create a lead-filled shoe. A pathway (236) may also be formed through the lead-filled shoe. In other embodiments, the LIB (202) may be a separate sub having a lead block and a pathway (236) formed through the lead block. The separate sub may be connected to a hollow body (230) of the valve in the hydrostatic bailer (204) using any connection known in the art, such as a threaded connection (238).

In accordance with one or more embodiments, the apparatus (118) may be lowered into the well (108) through the lubricator using the same techniques as outlined above with respect to the gauge cutter. In accordance with one or more embodiments, the apparatus (118) is lowered at moderate speed so as to not damage the sides of the LIB (202) or hydrostatic bailer (204). As the apparatus (118) is close to the expected depth of the fish (102) (e.g., 100 feet away), the speed of the apparatus (118) being lowered is slowed.

In accordance with one or more embodiments, the apparatus (118) is stopped around 10-20 feet above/up-hole from the fish (102). At this depth, the apparatus (118) is pulled 25 feet up to record the weight of the tool string. In S404, the apparatus (118) is lowered onto the fish (102) to obtain an impression of the fish (102) on the LIB (202). The lead in the LIB (202) is soft enough such that, when the LIB (202) is lowered on the upper surface (120) of the fish (102), a mirror image of the upper surface (120) of the fish (102) is pressed into the lead of the LIB (202).

In S406, a shear pin (224) in the hydrostatic bailer (204) is sheared to allow a plunger (220) to move and cause a pressure equalization to occur between a cavity (222) of the hydrostatic bailer (204) and a conduit (104) of the well (108) to open the valve. In S408, debris (122) is removed from an upper surface (120) of the fish (102), through the valve, and into the cavity (222) of the hydrostatic bailer (204) using the pressure equalization. In S410, the debris (122) is held in the cavity (222) of the hydrostatic bailer (204) using the valve.

The valve may be the ball valve (200) outlined in FIG. 2 or the flapper valve (300) outlined in FIG. 3 without departing from the scope of the disclosure herein. In accordance with one or more embodiments, when the pressure equalization is created between the cavity (222) and the well (108), the ball (226) is moved off of the ball seat (228) or the flapper (304) is moved away from the flapper seat (302) to uncover the inlet (232) in the ball seat (228)/flapper seat (302).

Once the inlet (232) is uncovered, hydraulic communication is able to occur between the orifice (234) of the hollow body (230) and the cavity (222) of the hydrostatic bailer (204). The hydraulic communication allows the suction pressure to pull in the adjacent wellbore fluids and debris (122) from the well (108), through the pathway (236) in the LIB (202), into the orifice (234) of the hollow body (230), through the inlet (232) in the valve, and into the cavity (222) of the hydrostatic bailer (204). Once the pressure is equalized in the cavity (222), the ball (226) falls down to land against the ball seat (228) or the flapper (304) is pushed against the flapper seat (302) to block the inlet (232) and hold the debris (122) in the cavity (222) of the hydrostatic bailer (204).

In S412, the apparatus (118) is pulled from the well (108) to analyze the debris (122) and the impression of the fish (102) to determine what type of fishing tool and fishing operation should be performed on the well (108) to remove the fish (102) from the well (108). In accordance with one or more embodiments, the apparatus (118) may be pulled out of the well (108) through the lubricator using the same techniques as outlined above with respect to the gauge cutter. Prior to opening the hydrostatic bailer (204) at the surface to retrieve the debris (122), safety precautions should be taken for any trapped pressure inside the cavity (222) of the hydrostatic bailer (204).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An apparatus for detecting a fish in a well, the apparatus comprising:

a hydrostatic bailer configured to be disposed in the well and remove debris from an upper surface of the fish, the hydrostatic bailer comprising:

a plunger located within a cavity of the hydrostatic bailer;

a shear pin holding the plunger in a loaded position within the hydrostatic bailer; and a valve comprising a ball valve, connected to a downhole end of a lower chamber sub, and configured to control hydraulic communication between an orifice of a hollow body of the valve and the cavity of the hydrostatic bailer by opening and closing, wherein the ball valve comprises the hollow body having the orifice, a ball seat having an inlet, and a ball, wherein the ball is configured to move off of the ball seat, toward the plunger, when the shear pin is sheared to uncover the inlet of the ball seat and create hydraulic communication between the orifice of the hollow body and the cavity of the hydrostatic bailer, and wherein the shear pin is configured to shear and allow the plunger to move within the hydrostatic bailer and movement of the plunger causes the valve to open and remove the debris from the upper surface of the fish; and a lead impression block connected to the hollow body of the valve in the hydrostatic bailer, wherein the lead impression block is configured to set against the fish, using the hydrostatic bailer, and obtain an impression of the fish, wherein the lead impression block is configured to obtain the impression of the fish during a single trip into the well in which the hydrostatic bailer is used to remove the debris from the upper surface of the fish.

2. The apparatus of claim 1, wherein the lead impression block further comprises lead filled into a shoe of the valve to create a lead-filled shoe and a pathway formed into a center of the lead-filled shoe.

3. The apparatus of claim 1, wherein the lead impression block further comprises a separate sub having a lead block and a pathway formed through the lead block and sub.

4. The apparatus of claim 3, wherein the separate sub is connected to the hollow body of the valve in the hydrostatic bailer using a threaded connection.

5. A method for detecting a fish in a well, the method comprising:

running an apparatus to a location adjacent to the fish in the well, wherein the apparatus comprises a lead impression block connected to a hydrostatic bailer using a valve;

wherein the valve comprises a ball valve, wherein the ball valve comprises the hollow body having the orifice, a ball seat having an inlet, and a ball, wherein the ball is configured to move off of the ball seat, toward the plunger, when the shear pin is sheared to uncover the inlet of the ball seat and create hydraulic communication between the orifice of the hollow body and the cavity of the hydrostatic bailer, lowering the apparatus onto the fish to obtain an impression of the fish on the lead impression block;

shearing a shear pin in the hydrostatic bailer to allow a plunger to move and cause a pressure equalization to occur between a cavity of the hydrostatic bailer and a conduit of the well to open the valve;

removing debris from an upper surface of the fish, through the valve, and into the cavity of the hydrostatic bailer using the pressure equalization, wherein the debris is removed from the upper surface of the fish during a single trip into the well in which the lead impression block is used to obtain the impression of the fish;

holding the debris in the cavity of the hydrostatic bailer using the valve; and pulling the apparatus from the well to analyze the debris and the impression of the fish to determine what type of fishing tool and fishing operation should be performed on the well to remove the fish from the well.

6. The method of claim 5, further comprising connecting the lead impression block to the valve of the hydrostatic bailer by filling lead into a shoe of the valve to create a lead-filled shoe and forming a pathway into a center of the lead-filled shoe.

7. The method of claim 5, wherein the lead impression block further comprises a separate sub having a lead block and a pathway formed through the lead block and sub.

8. The method of claim 7, further comprising connecting the separate sub to a hollow body of the valve in the hydrostatic bailer using a threaded connection.

9. An apparatus for detecting a fish in a well, the apparatus comprising:

a hydrostatic bailer configured to be disposed in the well and remove debris from an upper surface of the fish, the hydrostatic bailer comprising:

a plunger located within a cavity of the hydrostatic bailer;

a shear pin holding the plunger in a loaded position within the hydrostatic bailer; and a valve comprising a flapper valve, connected to a downhole end of a lower chamber sub, and configured to control hydraulic communication between an orifice of a hollow body of the valve and the cavity of the hydrostatic bailer by opening and closing, wherein the flapper valve comprises the hollow body having the orifice, a flapper seat having an inlet, and a flapper, wherein the flapper is configured to uncover the inlet in the flapper seat by moving towards the plunger when the shear pin is sheared to create hydraulic communication between the orifice of the hollow body and the cavity of the hydrostatic bailer, and wherein the shear pin is configured to shear and allow the plunger to move within the hydrostatic bailer and movement of the plunger causes the valve to open and remove the debris from the upper surface of the fish; and a lead impression block connected to the hollow body of the valve in the hydrostatic bailer, wherein the lead impression block is configured to set against the fish, using the hydrostatic bailer, and obtain an impression of the fish, wherein the lead impression block is configured to obtain the impression of the fish during a single trip into the well in which the hydrostatic bailer is used to remove the debris from the upper surface of the fish.

* * * * *